US007975680B1

(12) United States Patent
Montgomery

(10) Patent No.: US 7,975,680 B1
(45) Date of Patent: Jul. 12, 2011

(54) ARROW REST

(76) Inventor: Bill Montgomery, Jonesboro, LA (US)

( * ) Notice: Subject to any disclaimer, the term of this patent is extended or adjusted under 35 U.S.C. 154(b) by 457 days.

(21) Appl. No.: 12/221,501

(22) Filed: Aug. 4, 2008

Related U.S. Application Data

(60) Provisional application No. 60/963,110, filed on Aug. 3, 2007.

(51) Int. Cl.
*F41B 5/22* (2006.01)

(52) U.S. Cl. ..... 124/44.5

(58) Field of Classification Search ..... 124/24.1, 124/44.5
See application file for complete search history.

(56) References Cited

U.S. PATENT DOCUMENTS

| | | | | |
|---|---|---|---|---|
| 4,236,497 | A | 12/1980 | Troncoso, Jr. | 124/24 R |
| 4,372,282 | A | 2/1983 | Sanders | 124/24 R |
| 5,025,773 | A | 6/1991 | Hintz et al. | 124/44.5 |
| 5,042,450 | A | 8/1991 | Jacobson | 124/44.5 |
| 5,181,502 | A | 1/1993 | Ray | 124/44.5 |
| 5,253,633 | A | 10/1993 | Sisko | 124/44.5 |
| 5,526,800 | A | 6/1996 | Christian | 124/44.5 |
| 6,772,747 | B1 | 8/2004 | Vastag | 124/44.5 |
| 6,776,149 | B1 | 8/2004 | Beeks | 124/44.5 |

*Primary Examiner* — John Ricci

(74) *Attorney, Agent, or Firm* — R. Keith Harrison

(57) ABSTRACT

An arrow rest for a bow. An illustrative embodiment of the arrow rest includes a generally C-shaped arrow rest frame having a frame attachment segment, a guard segment extending from a first end of the frame attachment segment, an arrow support segment extending from a second end of the frame attachment segment, a pin support segment extending from the arrow rest segment and a frame opening defined by the arrow rest frame; a flexible arrow retainer pin extending from the pin support segment into the frame opening; and an attachment mechanism provided on the frame attachment segment of the arrow rest frame.

17 Claims, 4 Drawing Sheets

ARROW REST

CROSS-REFERENCE TO RELATED APPLICATIONS

This application claims the benefit of and incorporates by reference in its entirety U.S. Provisional patent application No. 60/963,110, filed Aug. 3, 2007 and entitled "Arrow Rest".

FIELD

The present disclosure relates to archery equipment. More particularly, the present disclosure relates to an arrow rest for archery equipment.

BACKGROUND

An arrow rest is a support which is provided on a bow frame of an archery bow to support the middle segment of an arrow preparatory to and during shooting of the arrow from the bow. The design of the arrow rest must not interfere with release of the arrow from the bow. Furthermore, the arrow rest should be designed to securely hold the arrow in a launching or ready-to-shoot position whether the bow is vertical or tilted radially, as often occurs during hunting or bow fishing. In the event that it slips from the launching position, the arrow must be repositioned on the arrow rest before the bowstring can be drawn and the arrow properly shot. If this slipping of the arrow from the launching position occurs at a time when the opportunity to shoot game or fish is presented, the arrow will likely be miscast and miss its intended target.

SUMMARY

The present disclosure is generally directed to an arrow rest for a how. An illustrative embodiment of the arrow rest includes a generally C-shaped arrow rest frame having a frame attachment segment, a guard segment extending from a first end of the frame attachment segment, an arrow support segment extending from a second end of the frame attachment segment, a pin support segment extending from the arrow rest segment and a frame opening defined by the arrow rest frame; a flexible arrow retainer pin extending from the pin support segment into the frame opening; and an attachment mechanism provided on the frame attachment segment of the arrow rest frame.

BRIEF DESCRIPTION OF THE DRAWINGS

The disclosure will now be made, by way of example, with reference to the accompanying drawings, in which.

DETAILED DESCRIPTION

Figure 1:
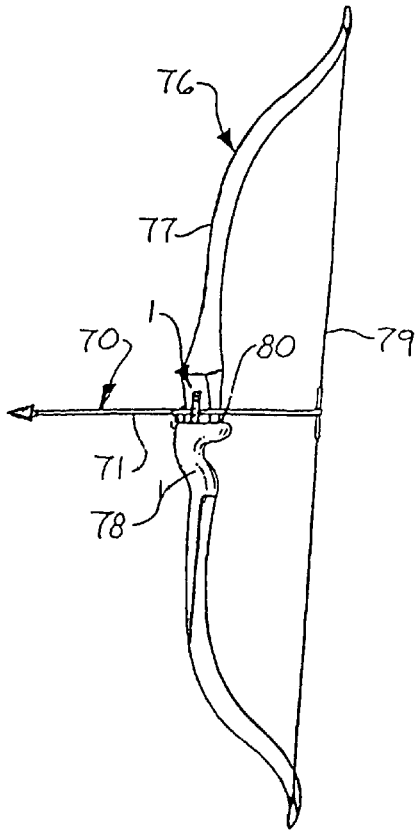
FIG. 1 is a side view of a bow, with an illustrative embodiment of the arrow rest provided on the bow and holding an arrow preparatory to drawing and shooting of the arrow.
Figure 2:
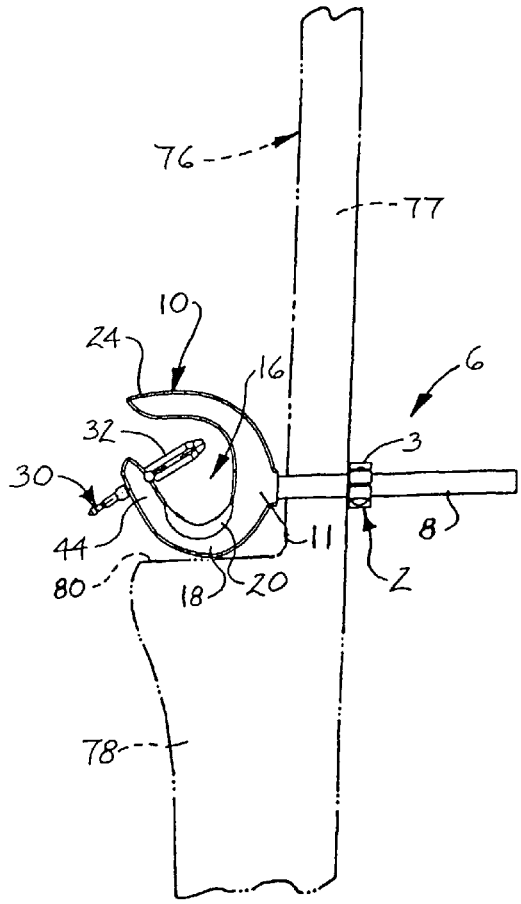
FIG. 2 is a rear view of an illustrative embodiment of the arrow rest, provided on a bow (illustrated in phantom) and supporting an arrow preparatory to drawing and shooting of the arrow.
Figure 11:
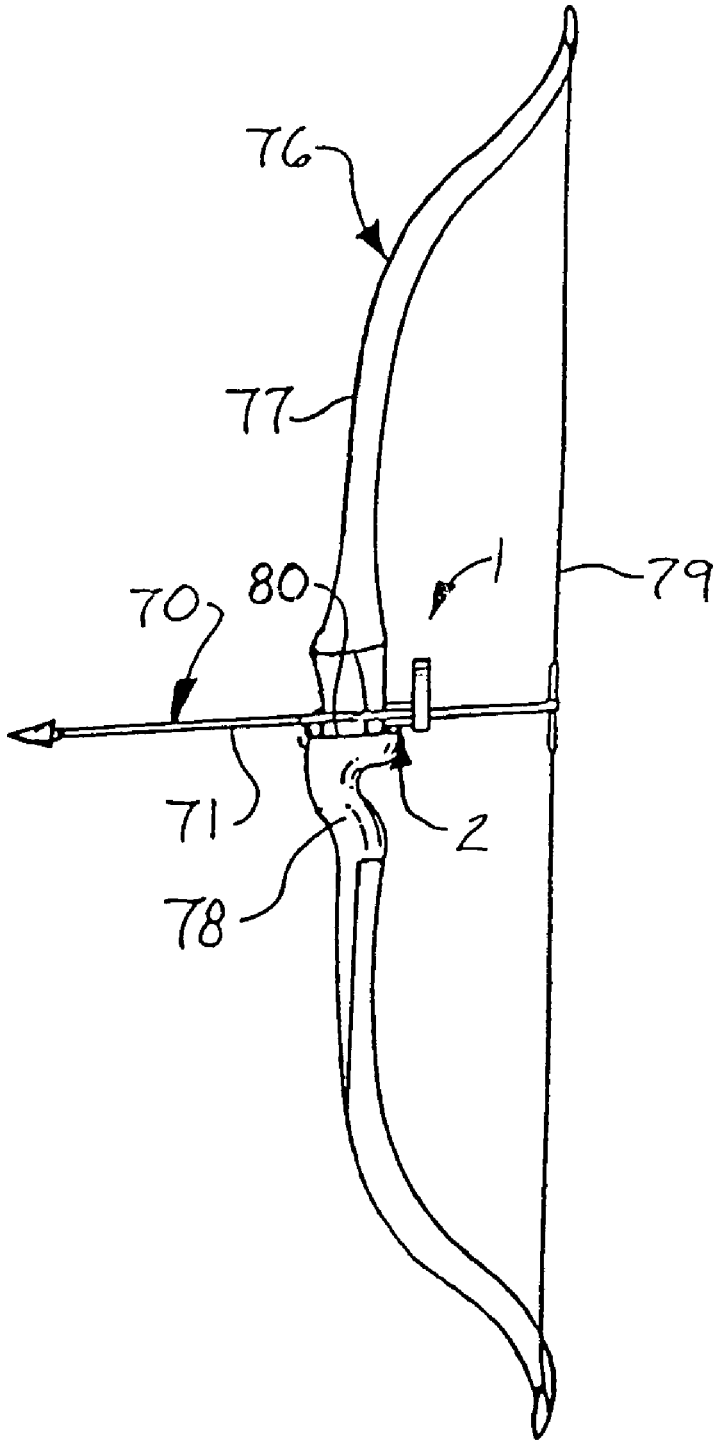
FIG. 11 is a side view of a bow, with an illustrative embodiment of the arrow rest provided on the bow behind the bow frame and holding an arrow preparatory to drawing and shooting of the arrow.

Referring initially to FIGS. 1, 2 and 11 of the drawings, an illustrative embodiment of the arrow rest is generally indicated by reference numeral 1. As will be hereinafter described, the arrow rest 1 is adapted to be mounted on a bow 76 such as that which is used for bow fishing, for example. The bow 76 may have a conventional design and includes a generally elongated, flexible bow frame 77. As illustrated in FIGS. 1 and 11, a bow string 79 extends between respective ends of the bow frame 77. A bow handle 78 is provided on the bow frame 77 between the ends thereof. An arrow rest surface 80 is typically provided on the bow frame 77 adjacent to the bow handle 78. As illustrated in FIG. 1, in one application the arrow rest 1 is attached to the bow frame 77 generally above the arrow rest surface 80 typically in a manner which will be hereinafter described. As illustrated in FIGS. 2 and 11, in another application the arrow rest 1 is attached to the bow frame 77 and positioned generally behind the arrow rest surface 80 typically in a manner which will be hereinafter described.

Figure 3:
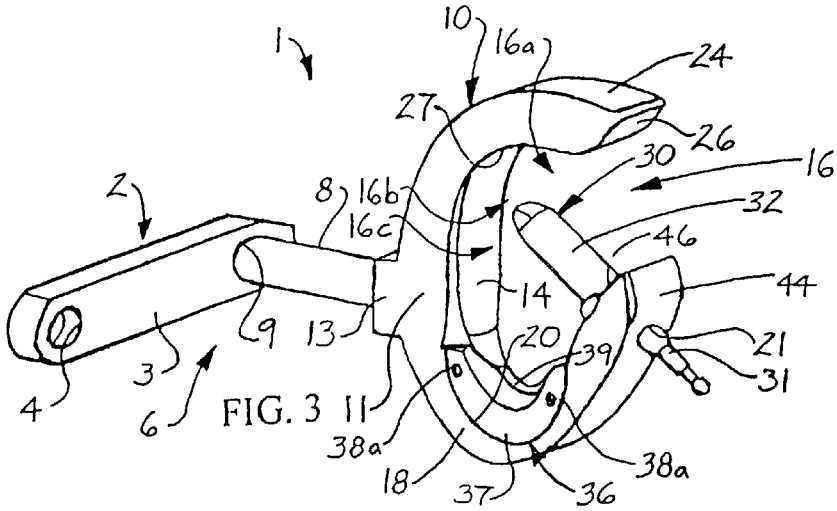
FIG. 3 is a front perspective view of an illustrative embodiment of the arrow rest.

Referring next to FIGS. 1, 3-8, 10 and 11 of the drawings, the arrow rest 1 includes a generally C-shaped arrow rest frame 10. An attachment mechanism 6 attaches the arrow rest frame 10 to the bow frame 77 of the bow 76 according to the knowledge of those skilled in the art. In some embodiments, the attachment mechanism 6 includes a mount bracket 2 having a generally elongated mount bracket body 3. The mount bracket body 3 is adapted for attachment to the bow riser or frame 77 of the bow 76 (FIG. 2) using any suitable technique which is known by those skilled in the art. For example, as illustrated in FIG. 3, at least one fastener opening 4 may extend through the mount bracket body 3. A fastener (not illustrated) extends through the fastener opening 4 and is threaded into a registering fastener opening (not illustrated) which is provided in the bow frame 77 of the bow 76.

A generally elongated mount shaft 8 extends from the mount bracket body 3 of the mount bracket 2. The mount shaft 8 may be attached to the mount bracket body 3 using any suitable technique which is known by those skilled in the art. As illustrated in FIG. 3, in some embodiments a mount shaft opening 9 extends through the mount bracket body 3 in spaced-apart relationship with respect to the fastener opening 4. The mount shaft 8 extends through the mount shaft opening 9. As illustrated in FIG. 11, the mount bracket body 3 of the mount bracket 2 extends rearwardly from the bow frame 77 and the arrow rest frame 10 is oriented generally behind the arrow rest surface 80 of the bow 76. The mount shaft 8 may be adjustable in the mount shaft opening 9 to selectively vary the length of extension of the mount shaft 8 from the mount bracket body 3.

As illustrated in FIG. 1, in alternative applications the mount shaft 8 extends through both the mount shaft opening 9 (FIG. 3) provided in the mount bracket body 3 and a mount shaft opening (not illustrated) which extends through the bow frame 77 of the bow 76, generally adjacent to the arrow rest surface 80. Accordingly, the arrow rest frame 10 is oriented just above the arrow rest surface 80, generally adjacent to the bow frame 77.

Figure 4:
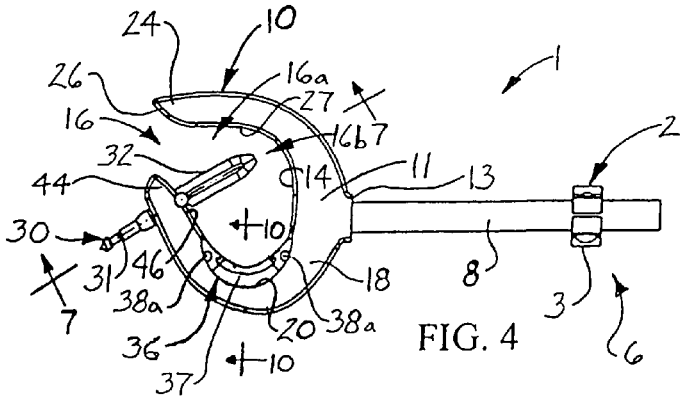
FIG. 4 is a rear view of an illustrative embodiment of the arrow rest.
Figure 5:
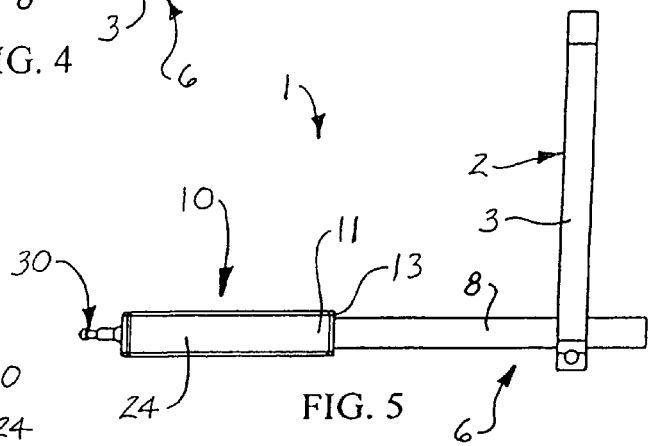
FIG. 5 is a top view of an illustrative embodiment of the arrow rest.
Figure 6:
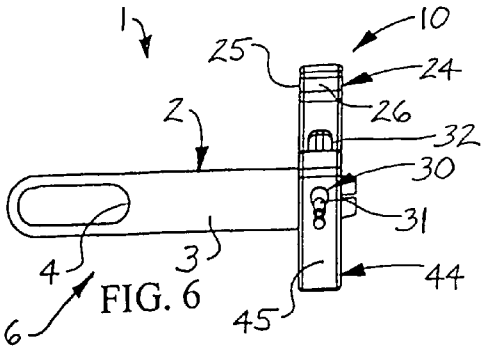
FIG. 6 is a side view of an illustrative embodiment of the arrow rest.
Figure 7:
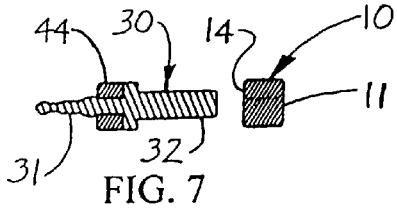
FIG. 7 is a sectional view, taken along section lines 7-7 in FIG. 4.

The arrow rest frame 10 may be a metal such as aluminum, for example. Alternatively, the arrow rest frame 10 may be plastic or other suitable material. As illustrated in FIG. 7, in some embodiments the arrow rest frame 10 has a generally rectangular cross-sectional shape. As illustrated in FIGS. 3 and 4, the arrow rest frame 10 includes a frame attachment segment 11; a guard segment 24 and an arrow support segment 18 which extend from opposite ends of the frame attachment segment 11; and a pin support segment 44 which extends from the arrow support segment 18. The frame attachment segment 11, guard segment 24 and arrow support segment 18 of the arrow rest frame 10 define a frame opening 16.

The frame attachment segment 11 of the arrow rest frame 10 has a generally elongated shape. In some embodiments, an attachment extension 13 extends from the frame attachment segment 11 and is attached to the extending or distal end of the mount shaft 8 according to the knowledge of those skilled in the art. The frame attachment segment 11 has a generally flat interior surface 14.

The guard segment 24 has a generally elongated, curved shape and extends from a first end of the frame attachment segment 11. A bevel 26 may terminate the extending or distal end of the guard segment 24. The guard segment 24 has a generally flat interior surface 27 which is continuous with the interior surface 14 of the frame attachment segment 11.

Figure 10:
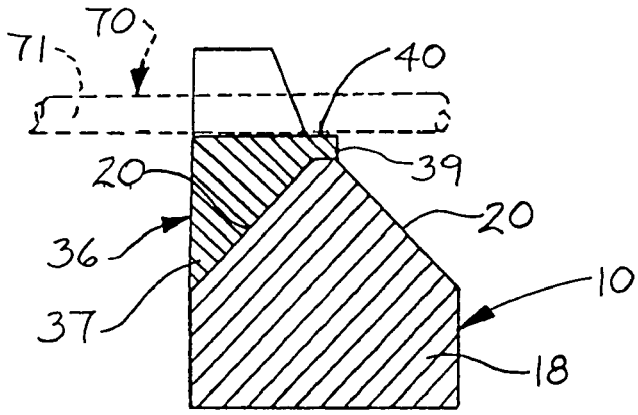
FIG. 10 is a cross-sectional view of the arrow rest frame and arrow rest insert components of an illustrative embodiment of the arrow rest, taken along section lines 10-10 in FIG. 4.

The arrow support segment 18 has a generally elongated, curved shape and extends from a second end of the frame attachment segment 11. The arrow support segment 18 is disposed in spaced-apart relationship with respect to the guard segment 24. As illustrated in FIG. 10, in some embodiments, a pair of ramp surfaces 20 is provided in the interior portion of the arrow support segment 18 which faces the frame opening 18 of the arrow rest frame 10. An arrow rest insert 36, which is typically plastic, is seated against a selected one of the ramp surfaces 20 and attached to the arrow rest frame 10 typically in a manner which will be hereinafter described. In some embodiments, the ramp surfaces 20 and the arrow rest insert 36 are omitted from the arrow rest frame 10.

Figure 8:
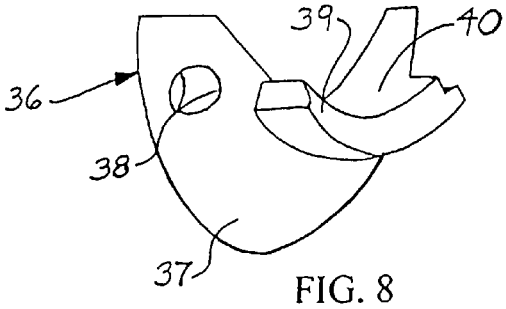
FIG. 8 is a perspective view of an arrow rest insert element of an illustrative embodiment of the arrow rest.

As illustrated in FIG. 8, the arrow rest insert 36 typically includes a generally elongated, curved or crescent-shaped insert body portion 37. A generally elongated, curved insert flange 39 extends from the insert body portion 37. The insert body portion 37 and the insert flange 39 together define an arrow rest surface 40. The configuration of the ramp surface 20 provided in the arrow support segment 18 of the arrow rest frame 10 is typically crescent-shaped and congruent with the configuration of the insert body portion 37 and the insert flange 39 of the arrow rest insert 36. Accordingly, the insert body portion 37 of the arrow rest 36 is seated against the ramp surface 20. The arrow rest insert 36 may be attached to the arrow support segment 18 using any suitable technique which is known by those skilled in the art. In some embodiments, multiple fastener openings 38 (one of which is illustrated in FIG. 8) extends through the insert body portion 37 of the arrow rest insert 36. A fastener 38*a* extends through each fastener opening 38 and is threaded into a corresponding registering threaded fastener opening (not illustrated) provided in the arrow support segment 18. In some embodiments, the arrow rest insert 36 is integral with the arrow support segment 18 of the arrow rest frame 10 rather than being a separate element.

The pin support segment 44 of the arrow rest frame 10 has a generally elongated shape and extends from the arrow support segment 18. The pin support segment 44 has a generally flat interior surface 46 which extends adjacent to the ramp surface 20 of the arrow support segment 18.

An arrow retainer pin 30 extends from the pin support segment 44, into the frame opening 16 of the arrow rest frame 10. The arrow retainer pin 30 is a flexible material such as rubber or plastic, for example. The arrow retainer pin 30 may be attached to the pin support segment 44 using any suitable attachment technique which is known by those skilled in the art. In some embodiments, a pin opening 21 extends through the pin support segment 44. The arrow retainer pin 30 includes a generally elongated insertion segment 31 which extends through the pin opening 21. A generally elongated extending segment 32 extends from the insertion segment 31, into the frame opening 16. The arrow retainer pin 30 may extend from any point on the arrow rest frame 10 and into the frame opening 16. For example, in some embodiments, the arrow retainer pin 30 may extend from the frame attachment segment 11 or the guard segment 24 and into the frame opening 16.

As illustrated in FIGS. 3 and 4, the frame opening 16 includes an insertion portion 16*a* which is defined between the guard segment 24 and the pin support segment 44; a pin gap 16*b* which is defined between the extending segment 32 of the arrow retainer pin 30 and the frame attachment segment 11; and an arrow rest portion 16*c* which is defined between the extending segment 32 of the arrow retainer pin 30 and the pin support segment 44, the arrow support segment 18 and the frame attachment segment 11 of the arrow rest frame 10.

Referring again to FIGS. 1, 2 and 11 of the drawings, in typical use the arrow rest 1 is attached to the bow 76 typically using the attachment mechanism 76 as was heretofore described. Accordingly, as illustrated in FIG. 1, in some applications of the arrow rest 1, the mount bracket 2 is attached to the bow frame 77 just above the arrow rest surface 80 and generally adjacent to the riser or bow frame 77. The mount shaft 8 extends through both the mount shaft opening 9 (FIG. 3) provided in the mount bracket body 3 of the mount bracket 2 and the mount shaft opening (not illustrated) provided in the bow frame 77. The arrow rest frame 10 may be positioned on the left-handed side of the bow frame 77, as illustrated in FIG. 1, or may alternatively be positioned on the right-handed side of the bow frame 77. The arrow rest insert 36 (FIG. 3) is typically attached to the ramp surface 20 on the side of the arrow rest frame 10 which faces away from a shooter (not illustrated) of the bow 76, whereas the remaining exposed ramp surface 20 faces the shooter, as illustrated in FIG. 2. The mount shaft 8 is typically adjusted in the mount shaft opening 9 (FIG. 3) of the mount bracket 2 and the mount shaft opening 81 (FIG. 2) of the bow frame 77 to position the arrow rest frame 10 in selected proximity to the bow frame 77, as indicated by the double-headed arrow in FIG. 2.

As illustrated in FIGS. 2 and 11, in other applications of the arrow rest 1, a fastener (not illustrated) extends through the fastener opening 4 (FIG. 3) of the mount bracket body 3 of the mount bracket 2 and through a registering fastener opening (not illustrated) provided in the bow frame 77. The mount bracket body 3 of the mount bracket 2 extends rearwardly from and beyond the bow frame 77 and the arrow rest frame 10 is oriented generally behind the arrow rest surface 80 of the bow 76. The mount shall 8 may be adjustable in the mount shaft opening 9 to selectively vary the length of extension of the mount shaft 8 from the mount bracket body 3.

An arrow 70 is positioned in the arrow rest frame 10, preparatory to shooting of the arrow 70, by inserting the elongated arrow shaft 71 of the arrow 70 lengthwise through the insertion portion 16*a* and the pin gap 16*b*, respectively; and then into the arrow rest portion 16*c* of the frame opening 16. As the bow 76 is held with the how frame 77 oriented in a generally vertical position, the arrow shaft 71 is placed on the arrow rest surface 40 (FIG. 8) of the arrow rest insert 36. As illustrated in FIG. 1, the bow string 79 of the bow 76 is then engaged with the arrow shaft 71, after which the bow string 79 is drawn and released to shoot the arrow 70 from the bow 76. It will be appreciated by those skilled in the art that the bow frame 77 of the how 76 can be tilted with respect to the vertical, as often occurs during bow fishing and hunting, for example, without dislodging the arrow 70 from the launching or ready-to-shoot position. As the arrow 70 is released from the bow 76, the arrow shaft 71 passes through the frame opening 16 of the arrow rest frame 10. In the event that the arrow 70 is improperly loaded in the frame opening 16 of the arrow rest frame 10, the exposed ramp surface 20 which faces the shooter prevents damage to the arrow shaft 71 when the arrow shaft 71 strikes the ramp surface 20 during launching of the arrow 70 from the bow 76.

Figure 9:
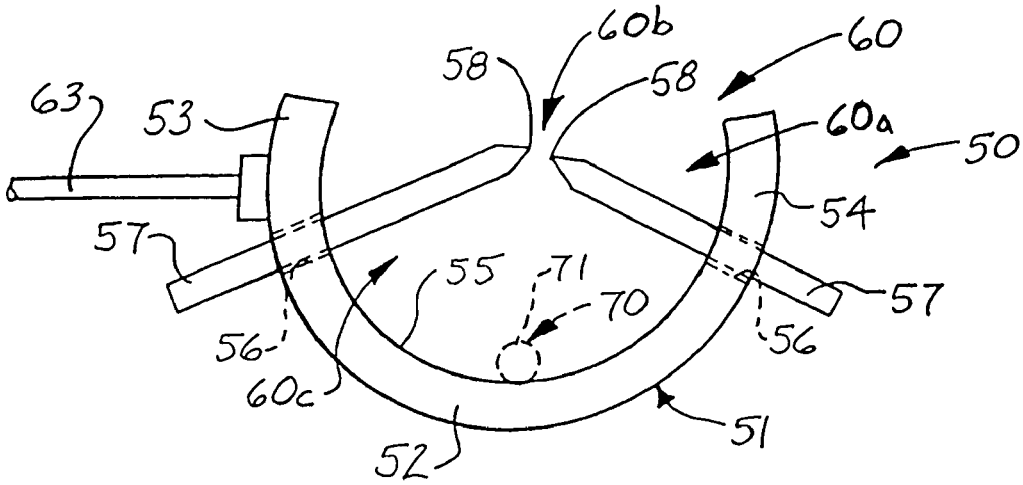
FIG. 9 is a front view of an alternative illustrative embodiment of the arrow rest.

Referring next to FIG. 9 of the drawings, an alternative illustrative embodiment of the arrow rest is generally indicated by reference numeral 50. The arrow rest 50 includes a generally elongated, curved arrow rest frame 51 having a curved central segment 52; a curved attachment segment 53 extending from a first end of the central segment 52; and a curved extended segment 54 extending from a second end of the central segment 52. The central segment 52, the attachment segment 53 and the extended segment 54 define a frame opening 60. A generally flat arrow rest surface 55 is provided on the interior concave portion of the central portion 52 of the arrow rest frame 51 and faces the frame opening 60.

A pair of arrow retainer pins 57 extends from the attachment segment 53 and the extended segment 54, respectively, and into the frame opening 60 of the arrow rest frame 51. The arrow retainer pins 57 are oriented at a generally obtuse angle with respect to each other. In some embodiments, a pair of pin openings 56 extends through the attachment segment 53 and the extended segment 54, respectively, into the frame opening 60. Each arrow retainer pin 57 is typically friction-fitted in and extends through the corresponding pin opening 56. Alternatively, each arrow retainer pin 57 may be threaded in the corresponding pin opening 56. Each arrow retainer pin 57 has a pointed end 58 which extends into the frame opening 60. The frame opening 60 includes an insertion portion 60*a* which is defined between the arrow rest frame 51 and each arrow retainer pin 57, a pin gap 60*b* which is defined between the pointed ends 58 of the respective arrow retainer pins 57 and an arrow rest portion 60*c* which is defined between the central segment 52 and the arrow retainer pins 57. A mount shaft 63 extends from the attachment segment 53 of the arrow rest frame 51 for attachment to a bow frame 77 (FIG. 2) of a bow 76, such as was heretofore described with respect to the attachment mechanism 6 of the arrow rest 1 of FIGS. 1-8.

In typical use, the arrow rest 60 is attached to a bow (not illustrated) such as the bow 76 which was heretofore described with respect to FIGS. 1 and 2, typically via the mount shaft 63. Accordingly, the arrow rest frame 51 is disposed generally above or adjacent to the arrow rest surface 80 (FIGS. 1 and 2) of the bow frame 77. An arrow (not illustrated) such as the arrow 70 which was heretofore described with respect to FIG. 1 is positioned in the arrow rest frame 51, preparatory to shooting of the arrow 70, by inserting the elongated arrow shaft 71 of the arrow 70 lengthwise through the insertion portion 60*a* and the pin gap 60*b*, respectively; and then into the arrow rest portion 60*c* of the frame opening 60. As the bow 76 is held with the bow frame 77 oriented in a generally vertical position, the arrow shaft 71 is placed on the arrow rest surface 55 of the arrow rest frame 51. The bow string 79 (FIG. 1) of the bow 76 is then engaged with the arrow shaft 71, after which the bow string 79 is drawn and released to shoot the arrow 70 from the bow 76. As the arrow 70 is released from the bow 76, the arrow shaft 71 passes through the frame opening 60 of the arrow rest frame 51.

While the illustrative embodiments of the disclosure have been described above, it will be recognized and understood that various modifications can be made in the embodiments and the appended claims are intended to cover all such modifications which may fall within the spirit and scope of the disclosure.

What is claimed is:

1. An arrow rest, comprising:

a generally C-shaped arrow rest frame having a frame attachment segment, a guard segment extending from a first end of said frame attachment segment, an arrow support segment extending from a second end of said frame attachment segment, a pin support segment extending from said arrow support segment and a frame opening defined by said arrow rest frame;

a flexible arrow retainer pin extending from said arrow rest frame into said frame opening;

an attachment mechanism provided on said frame attachment segment of said arrow rest frame; and an arrow rest insert provided on said arrow support segment of said arrow rest frame.

2. The arrow rest of claim 1 wherein said attachment mechanism comprises a mount shaft extending from said frame attachment segment and a mount bracket provided on said mount shaft.

3. The arrow of claim 2 further comprising an attachment extension extending from said frame attachment segment of said arrow rest frame and wherein said mount shaft extends from said attachment extension.

4. The arrow rest of claim 2 further comprising a fastener opening extending through said mount bracket in spaced-apart relationship with respect to said mount shaft.

5. The arrow rest of claim 1 wherein said arrow rest insert comprises a generally curved insert body portion, a generally curved insert flange extending from said insert body portion and an arrow rest surface defined by said insert body portion and said insert flange.

6. The arrow rest of claim 1 wherein said arrow rest insert is integral with said arrow support segment.

7. The arrow rest of claim 1 wherein said arrow retainer pin extends from said pin support segment of said arrow rest frame.

8. An arrow rest, comprising:

a generally C-shaped arrow rest frame having a generally elongated and curved frame attachment segment, a generally elongated and curved guard segment extending from a first end of said frame attachment segment, a generally elongated and curved arrow support segment extending from a second end of said frame attachment segment, a generally elongated pin support segment extending from said arrow support segment and a frame opening defined by said arrow rest frame;

a pin opening provided in said arrow rest frame;

a flexible arrow retainer pin having an insertion segment extending through said pin opening and an extending segment extending from said insertion segment into said frame opening;

an attachment mechanism provided on said frame attachment segment of said arrow rest frame and comprising an attachment extension extending from said frame attachment segment, a mount shaft extending from said attachment extension and a mount bracket provided on said mount shaft.

9. The arrow rest of claim 8 further comprising a fastener opening extending through said mount bracket in spaced-apart relationship with respect to said mount shaft.

10. The arrow rest of claim 8 further comprising an arrow rest insert provided on said arrow support segment of said arrow rest frame.

11. The arrow rest of claim 10 wherein said arrow rest insert comprises a generally curved insert body portion, a generally curved insert flange extending from said insert body portion and an arrow rest surface defined by said insert body portion and said insert flange.

12. The arrow rest of claim 10 wherein said arrow rest insert is integral with said arrow support segment.

13. The arrow rest of claim 8 wherein said arrow retainer pin extends from said pin support segment of said arrow rest frame.

14. An arrow rest, comprising:

a generally C-shaped arrow rest frame having a generally elongated and curved frame attachment segment, a generally elongated and curved guard segment extending from a first end of said frame attachment segment, a generally elongated and curved arrow support segment extending from a second end of said frame attachment segment, a generally elongated pin support segment extending from said arrow support segment and a frame opening defined by said arrow rest frame;

wherein said arrow rest frame has flat interior surfaces facing said frame opening;

a pin opening provided in said arrow rest frame;

a flexible arrow retainer pin having an insertion segment extending through said pin opening and an extending segment extending from said insertion segment into said frame opening; and an attachment mechanism provided on said frame attachment segment of said arrow rest frame.

15. The arrow rest of claim 14 wherein said attachment mechanism comprises a mount shaft extending from said frame attachment segment and a mount bracket provided on said mount shaft.

16. The arrow rest of claim 15 further comprising an attachment extension extending from said frame attachment segment of said arrow rest frame and wherein said mount shaft extends from said attachment extension.

17. The arrow rest of claim 15 further comprising a fastener opening extending through said mount bracket in spaced-apart relationship with respect to said mount shaft.

* * * * *